United States Patent [19]

Hayes et al.

[11] Patent Number: 4,768,585

[45] Date of Patent: Sep. 6, 1988

[54] MOISTURE SEPARATOR REHEATER TUBE SUPPORT

[75] Inventors: James K. Hayes; David L. Crick, both of Chattanooga, Tenn.

[73] Assignee: Combustion Engineering, Inc., Windsor, Conn.

[21] Appl. No.: 863,768

[22] Filed: May 16, 1986

[51] Int. Cl.[4] ..... B22C 13/02

[52] U.S. Cl. ..... 165/162; 122/510

[58] Field of Search ..... 165/162; 122/510

[56] References Cited

U.S. PATENT DOCUMENTS

| | | | |
|---|---|---|---|
| 3,804,354 | 4/1974 | Weiss | 165/162 X |
| 4,079,702 | 3/1978 | Furukawa et al. | 122/510 X |
| 4,114,684 | 9/1978 | Jenis et al. | 165/162 X |
| 4,285,396 | 8/1981 | Schwoerer et al. | 165/162 |

FOREIGN PATENT DOCUMENTS

| | | | |
|---|---|---|---|
| 0050702 | 4/1979 | Japan | 122/510 |
| 0567076 | 8/1977 | U.S.S.R. | 165/162 |
| 0785639 | 12/1980 | U.S.S.R. | 165/162 |
| 0807030 | 2/1981 | U.S.S.R. | 165/162 |
| 2075658A | 11/1981 | United Kingdom | 165/162 |
| 2117503A | 10/1983 | United Kingdom | 165/162 |

*Primary Examiner*—Allen M. Ostrager

*Attorney, Agent, or Firm*—John H. Mulholland

[57] ABSTRACT

A moisture separator reheater (10) tube support where the tubes are resiliently supported on curve-shaped metal spring members (46 or 58–64) in a manner permitting differential thermal radial and axial growth between the tube runs (26) and the support and spacer plate (30). The moisture separator reheater (10) units are used in nuclear pressurized water reactor systems.

3 Claims, 2 Drawing Sheets

MOISTURE SEPARATOR REHEATER TUBE SUPPORT

BACKGROUND OF THE INVENTION

Moisture Separator-Reheater (MSR) units are used in nuclear pressurized water reactor systems to reheat the steam after it has passed through the high pressure turbine. MSR's have been plagued by warped tube bundles and support plates due mainly to thermal growth of the tube bundle and its interaction with the tube support plates. These problems have resulted in replacement of the tube bundle, repair of the tube supports, or even the complete replacement of the MSR unit, resulting in lost operating time and great expense.

SUMMARY OF THE INVENTION

In accordance with the invention, the tubes in the tube bundle of an MSR are supported in a support plate by resilient means which permit the tubes to grow axially, and the support plates to grow radially, due to thermal expansion. The resilient means is a curve-shaped metal member and can be either an O-ring or C-ring contained within a retainer member secured to the support plate; or it may be in the form of a curve-shaped edge portion of a metal sleeve welded to each tube. The sleeve has rolled sections attached thereto which act as a spring to absorb thermal growth.

DESCRIPTION OF THE PREFERRED EMBODIMENTS

Figure 1:
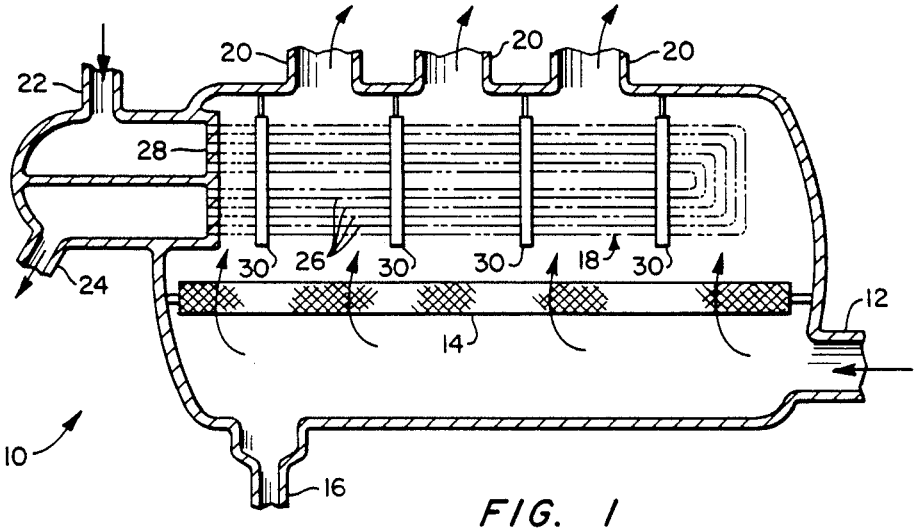
FIG. 1 is a sectional side view of a moisture-separator reheater (MSR) incorporating the invention.

Looking now to FIG. 1, there is shown a moisture separator-reheater (MSR) vessel 10, where moisture is removed from the cycle steam which exits from a high pressure turbine (not shown) of a nuclear power plant, and also where the steam is reheated before it is admitted to a low pressure turbine (not shown). The steam enters the unit through inlet 12, flowing upwardly through a wire mesh moisture separator 14. Separated moisture is discharged from the unit through lower outlet 16. The dried steam exiting the separator 14 flows through a heat exchanger or reheater 18, where it is heated to a higher temperature before exiting through outlets 20 to a low pressure turbine (not shown). Heating steam is supplied to the tubes of the tube bundle through inlet manifold 22, and after the steam has given up heat to the low pressure steam traversing the reheater outside of the tubes, it exits via outlet manifold 24.

The reheater 18 comprises a plurality of U-shaped tubes 26 which extend across the entire length of the MSR, with both ends being secured to the tube sheet 28. In order to properly space and support the tubes 26 along their entire length, a plurality of support plates 30 are spacedly provided. These plates are supported along their outer edges, and each plate has a plurality of holes or openings therein, with a tube leg or run extending through each. These support plates 30, although performing the needed task of spacing and supporting the tube legs, have been the source of problems in the past. The tubes and plates grow at different thermal expansion rates, and also the two legs of a single tube can grow at different rates. Thus, if adequate precautions are not taken, some of the tubes can become locked into one or more of the plates. This can cause bowing or warpage of the plates, and eventually lead to tube leaks or breaks.

Figure 2:
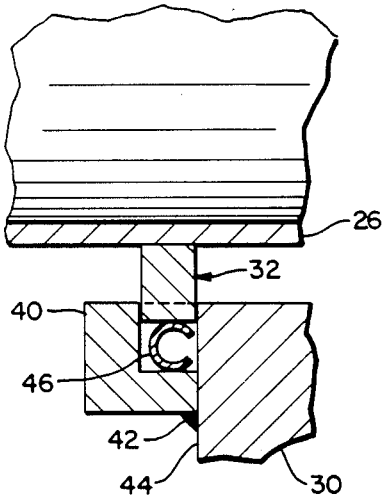
FIG. 2 is an enlarged sectional side view of one of the tubes of the tube bundle contained in the MSR.
Figure 3:
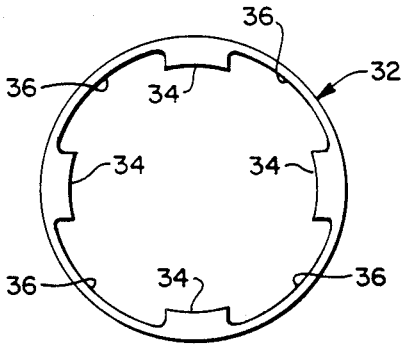
FIG. 3 is an end view of the restraining ring of FIG. 2.

Looking now to FIGS. 2 and 3, the manner in which the tubes is supported in the support plate are shown in more detail. Each tube leg 26 has a restraining ring 32 surrounding it at the location of each support plate 30. As can be seen in FIG. 3, the restraining rings have a plurality of equadistantly spaced enlarged portions 34 which are in close proximity or contact with the tube. In between, the ring has areas 36 which are somewhat spaced from the tube wall. Thus, the tube is adequately supported, while still not presenting so much frictional resistance to prevent the tubes from thermally expanding and moving axially relative to the restraining ring 32. Looking again to FIG. 2, an angled annular retainer ring 40 is welded at 42 to one end face 44 of the plate 30. Trapped or supported within the retainer ring is a metal annular C-ring 46. This C-ring acts as a spring to absorb radial growth, and also permits the tube 26 to grow axially without it becoming frozen or locked in the plate 30, while still adequately supporting and spacing this and the other tubes 26. The C-ring will spring back to its original shape when relaxation occurs during cool-down of the unit. Although a C-ring is shown, a flexible metal O-ring would work equally as well.

Figure 4:
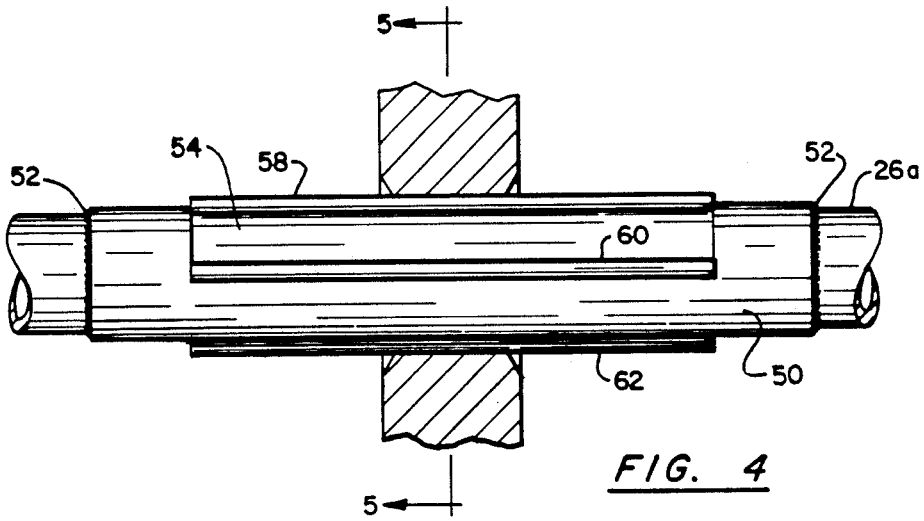
FIG. 4 is an elevational view of an alternative support arrangement of the invention.
Figure 5:
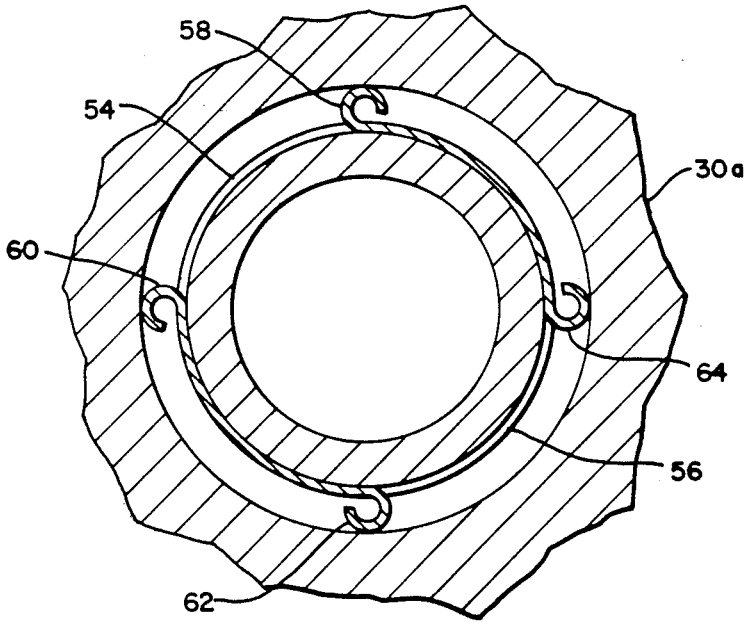
FIG. 5 is a view taken on line 5—5 of FIG. 4.

Looking now to FIGS. 4 and 5, an alternative tube support arrangement is shown which will allow relative axial and radial growth between the tube and its support. As can be seen, a sleeve 50 is attached to the tube 26(a) by silver solder 52 at its ends. The sleeve has a pair of openings 54, 56, cut therein in such a manner that sections 58, 60, and 62, 64 can be rolled back to form the openings. These rolled sections resiliently contact the support plate 30(a), and act as springs to permit the relative axial and radial growth between the tube legs and the support plate, and between the two legs of each U-tube.

What is claimed:

1. In combination, a heat exchanger, including a housing, a plurality of tubes, having parallel tube runs of substantial length located in the housing, a plurality of support plates positioned transverse to the parallel tube runs for properly spacing and supporting the parallel runs, each support plate having a plurality of openings therein, there being an opening for each parallel tube run, and curve-shaped metal spring means associated with the support plate and the parallel tube run for resiliently supporting each tube run in a manner that will allow differential thermal growth in both the radial and axial directions between the support plate and the tube runs.

2. The combination set forth in claim 1, wherein there is a ring slidably surrounding each tube run at a location adjacent each plate, and a flexible annular C-ring or O-ring held by the plate which abuts against the ring, both the ring and O-ring or C-ring being held by the plate in such a manner that they cannot move axially relative to the plate.

3. The combination set forth in claim 1, where in a metal sleeve is attached to each tube run at a location adjacent each plate, each sleeve having a plurality of tabs formed thereon, which are in the form of curve-shaped spring coils which abut against the walls of the openings of the plates.

* * * * *